US005984394A

United States Patent [19]

Bergeron

[11] Patent Number: 5,984,394

[45] Date of Patent: Nov. 16, 1999

[54] POWER BUCKET

[76] Inventor: Raymond E. Bergeron, 3452 W. Jefferson, Trenton, Mich. 48183

[21] Appl. No.: 09/105,868

[22] Filed: Jun. 26, 1998

[51] Int. Cl.[6] ..... B66C 3/02

[52] U.S. Cl. ..... 294/68.23; 294/111; 37/184

[58] Field of Search ..... 294/68.1, 68.21, 294/68.23, 111, 112; 37/461, 184, 185; 414/624–626

[56] References Cited

U.S. PATENT DOCUMENTS

| | | | |
|---|---|---|---|
| 528,375 | 10/1894 | Meier | 37/185 |
| 1,223,309 | 4/1917 | Botten | 37/184 |
| 1,664,359 | 3/1928 | Grout | 37/184 |
| 4,385,780 | 5/1983 | Grush | 294/68.23 |
| 4,998,762 | 3/1991 | Bergeron | 294/68.23 |
| 5,029,923 | 7/1991 | Bergeron | 294/68.23 |
| 5,209,535 | 5/1993 | Bergeron | 294/68.23 |
| 5,501,024 | 3/1996 | Bergeron | 37/184 |
| 5,553,404 | 9/1996 | Bergeron | 37/184 |
| 5,553,972 | 9/1996 | Bergeron et al. | 405/60 |

FOREIGN PATENT DOCUMENTS

| | | | |
|---|---|---|---|
| 2924-628 | 3/1981 | Germany | 294/68.23 |

*Primary Examiner*—Dean J. Kramer

*Attorney, Agent, or Firm*—Gifford, Krass, Groh, Sprinkle, Anderson & Citkowski, P.C.

[57] ABSTRACT

A power bucket is disclosed having a first and second bucket half, each forming a scoop. The bucket halves are pivotally secured together along their top so that the bucket halves are movable between an open position and a closed position. A pair of bearing assemblies is provided for pivotally securing the bucket halves together with the bearing assemblies being provided on opposite sides of the bucket halves. Each bearing assembly includes a cylindrical body having a smaller diameter pin extending coaxially outwardly from one side. The pin is positioned within an opening in the first bucket half and the cylindrical body is removably secured to the first bucket half by bolts. The cylindrical body of the bearing assembly is also positioned within a circular opening formed through the other bucket half so that the bucket halves can pivot relative to each other. An improved cantilevered axle assembly is also disclosed for the bucket closure line.

12 Claims, 3 Drawing Sheets

POWER BUCKET

BACKGROUND OF THE INVENTION

I. Field of the Invention

The present invention relates to a power bucket.

II. Description of the Prior Art

There are many previously known power buckets, oftentimes called clamshell buckets, comprising two bucket halves, each of which forms a scoop. The bucket halves are pivotally secured together along their tops so that the bucket halves are movable between an open position and a closed position. A closure line extends around pulleys secured to both bucket halves for moving the bucket halves from the open and to the closed position.

In order to pivotally secure the bucket halves together, it has been the previous practice to utilize an elongated cylindrical pivot pin extending along the entire length of the top of the power bucket. The pivot axle is secured to one of the bucket halves while opposite ends of the axle extend through registering openings formed in the other bucket half.

One disadvantage of this previously known construction, however, is that the pivot axis becomes worn after extended use. Indeed, the pivot pins and/or their connection with the bucket halves constitute the major wear position of the entire power bucket.

When the pivot axle and/or the power bucket halves at their pivotal connection with the axle become unduly worn, replacement of the pivot axle and/or repair of the power bucket halves must be performed. Such repair of the pivotal connection between the bucket halves, however, is not only expensive since it requires major reconstruction of the power bucket, but also results in extended down time for the power bucket.

These previously known power buckets also utilize at least one pulley rotatably mounted to the interior of each bucket half along the center line of the bucket half. A closure line then extends around the pulleys in the bucket halves to selectively move the bucket halves between their open and closed position.

In the previously known power buckets, an elongated axle typically extends across the entire width of each bucket half along its interior while the closure pulley is rotatably mounted around the axle. The elongated axles as well as their connection to the opposite sides of their associated bucket halves were previously necessary to ensure against deflection of the closure axles during operation of the power bucket. Such construction, however, was disadvantageous for a number of reasons.

One disadvantage of this previously known power bucket construction was that the closure axle, because it necessarily extended along the entire width of the bucket, was expensive and heavy in construction.

A still further disadvantage of this previously known construction is that the closure axles interfered with cleaning of the interior of the bucket. Such cleaning of the interior of the bucket, moreover, is required where the bucket is used in environmental cleanup operations.

SUMMARY OF THE PRESENT INVENTION

The present invention provides a power bucket which overcomes all of the above-mentioned disadvantages of the previously known power buckets.

In brief, the power bucket of the present invention comprises a first bucket half forming a first scoop. The first bucket half has a top, bottom and two spaced apart sides. The first bucket half also has a pair of registering openings formed in its opposing sides adjacent its top.

Similarly, the power bucket further includes a second bucket half forming a second scoop. The second bucket half, like the first bucket half, includes a top, a bottom and two spaced apart sides. The second bucket half also includes a pair of registering openings formed in its opposite sides adjacent its top. These registering openings in the second bucket half both register with the openings in the first bucket half and are larger in diameter than the openings of the first bucket half.

Means are then provided for pivotally securing the bucket halves together along their tops so that the bucket halves are movable between an open position and a closed position. An annular bearing having a circular opening is secured within each opening on the second bucket half. The pivotal securing means comprises a pair of bearing assemblies wherein each bearing assembly includes a cylindrical body having a diameter substantially the same as the bearing openings in the second bucket half as well as a cylindrical pin extending coaxially outwardly from one side of the body. The pin, furthermore, has a diameter substantially the same as the openings in the first bucket half. An annular reinforcing plate is also secured to the first bucket half around the bearing.

The bearing assemblies are removably secured to opposite sides of the first bucket half so that the pins are respectively positioned within the openings in the first bucket half while the cylindrical bodies are respectively positioned within the registering openings in the second bucket half. The bearing assemblies are then removably secured to the first bucket half by any conventional means, such as bolts.

Since the bearing assemblies are removably secured to the first half of the power bucket, the bearing assemblies can be relatively rapidly and inexpensively removed and replaced whenever required.

The power bucket of the present invention also includes a center wall assembly positioned substantially midway and parallel to the sidewalls of the bucket halves. Each wall assembly, furthermore, comprises a pair of spaced apart wall sections.

In order to rotatably mount a closure pulley to the center wall, a pivot axle is fixedly secured to each wall section of the center wall assembly so that the closure axle extends outwardly from at least one side of the center wall assembly. A closure pulley is then rotatably mounted to each closure axle such that the closure pulleys are cantilevered out from one side of the center wall assembly.

Still further improvements and features of the present invention will be had with reference to the detailed description of the invention that follows.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
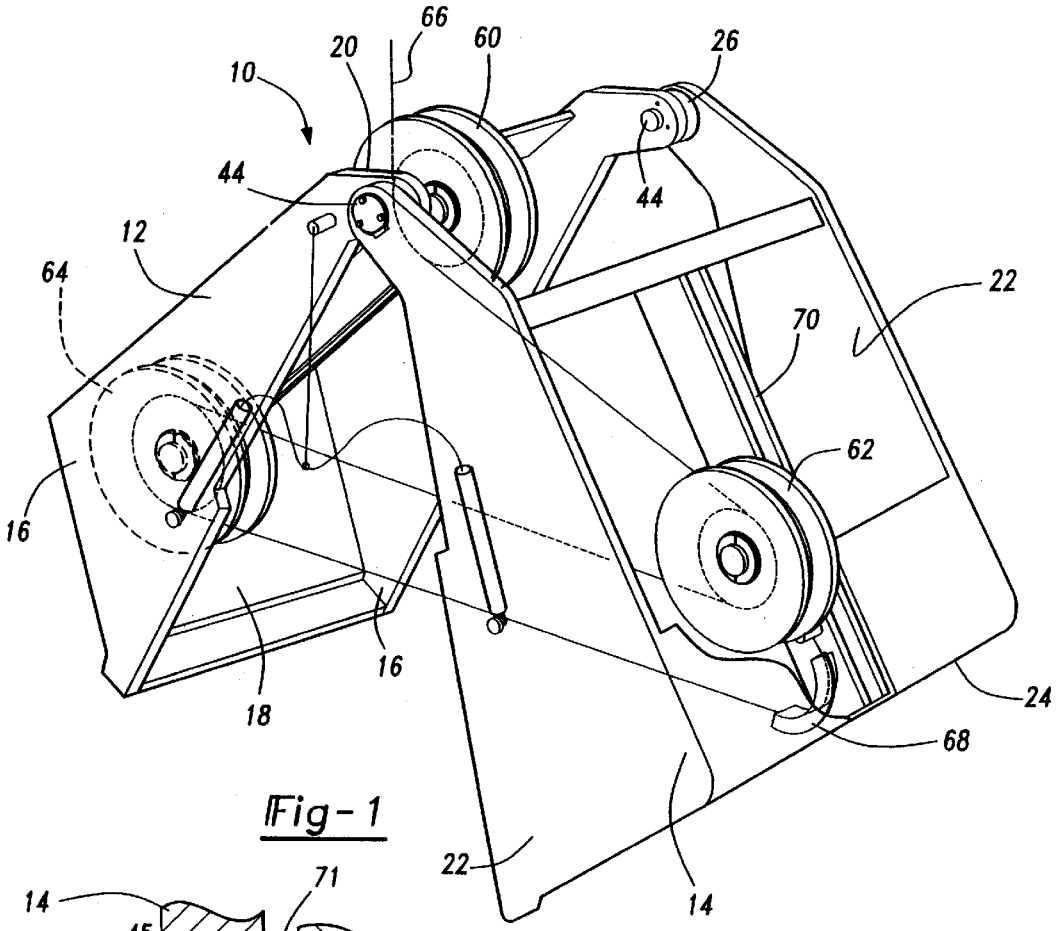
FIG. 1 is an elevational view illustrating a preferred embodiment of the present invention and with parts removed for clarity.
Figure 5:
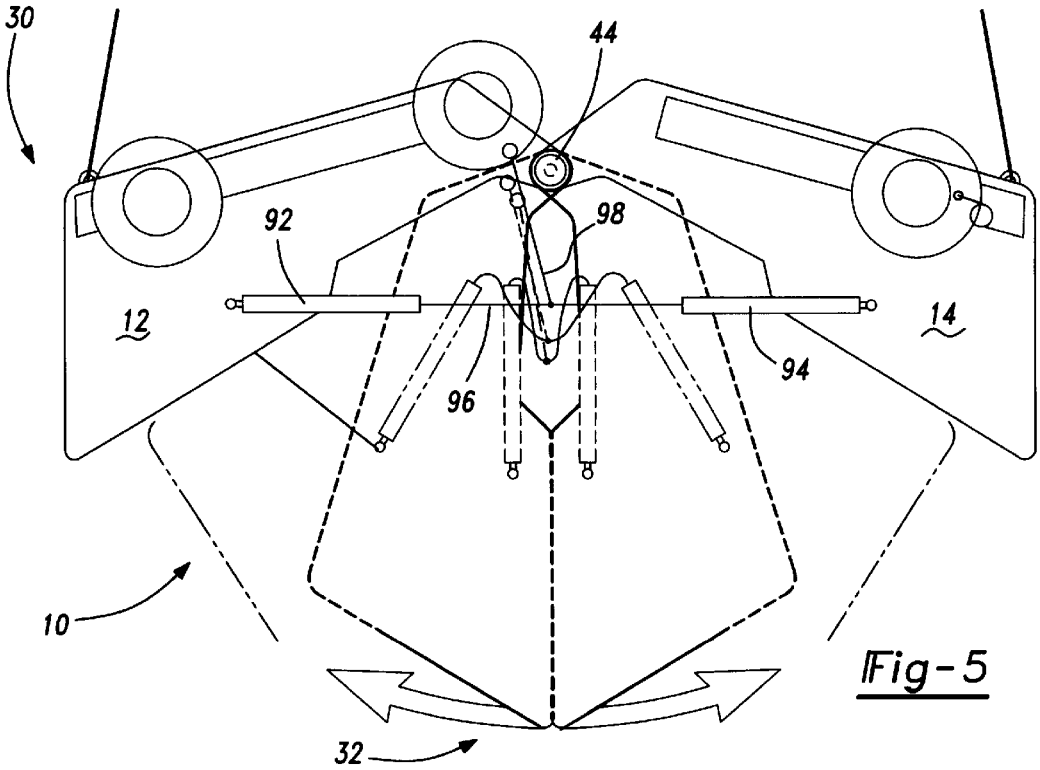
FIG. 5 is a side view illustrating the operation of the preferred embodiment of the present invention.

With reference first to FIGS. 1 and 5, a preferred embodiment of the power bucket 10 of the present invention is there shown and comprises a first bucket half 12 and a second bucket half 14. The first bucket half 12 includes a pair of spaced. sides 16, a bottom 18 and a top 20. Similarly, the same bucket half 14 also includes a pair of spaced apart sides 22, a bottom 24 and a top 26. Each bucket half 12 and 14 thus forms a scoop.

With reference now to FIG. 5, the bucket halves 12 and 14 are pivotally secured together along their tops and at their opposite sides by a bearing assembly 44. The bearing assembly 44, which will subsequently be described in greater detail, thus enables the bucket halves 12 and 14 to move between their open position, illustrated at 30, and their closed position, illustrated at 32.

Figure 3:
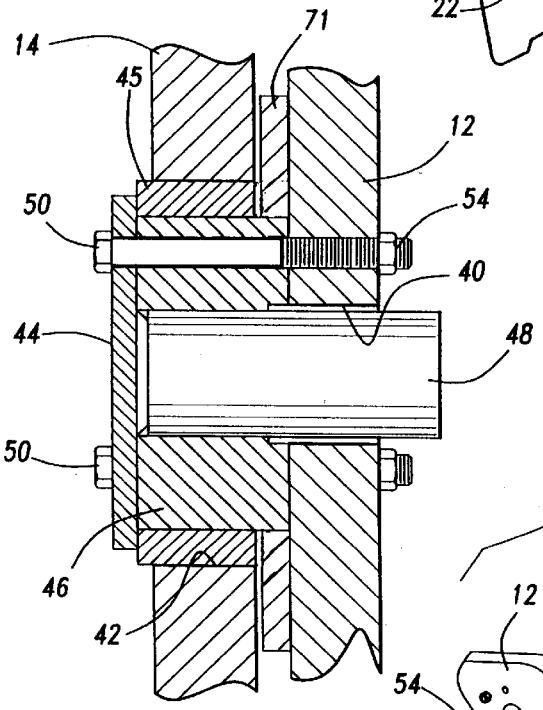
FIG. 3 is a sectional view illustrating the pivot assembly of the present invention.
Figure 2:
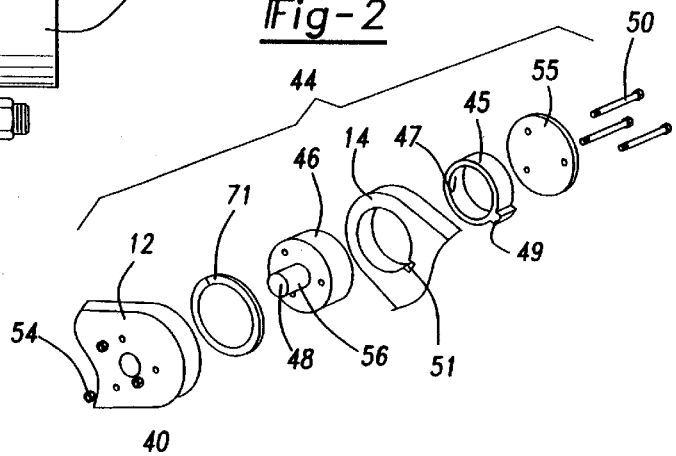
FIG. 2 is a fragmentary exploded view illustrating the pivot assembly of the preferred embodiment of the present invention.
Figure 4:
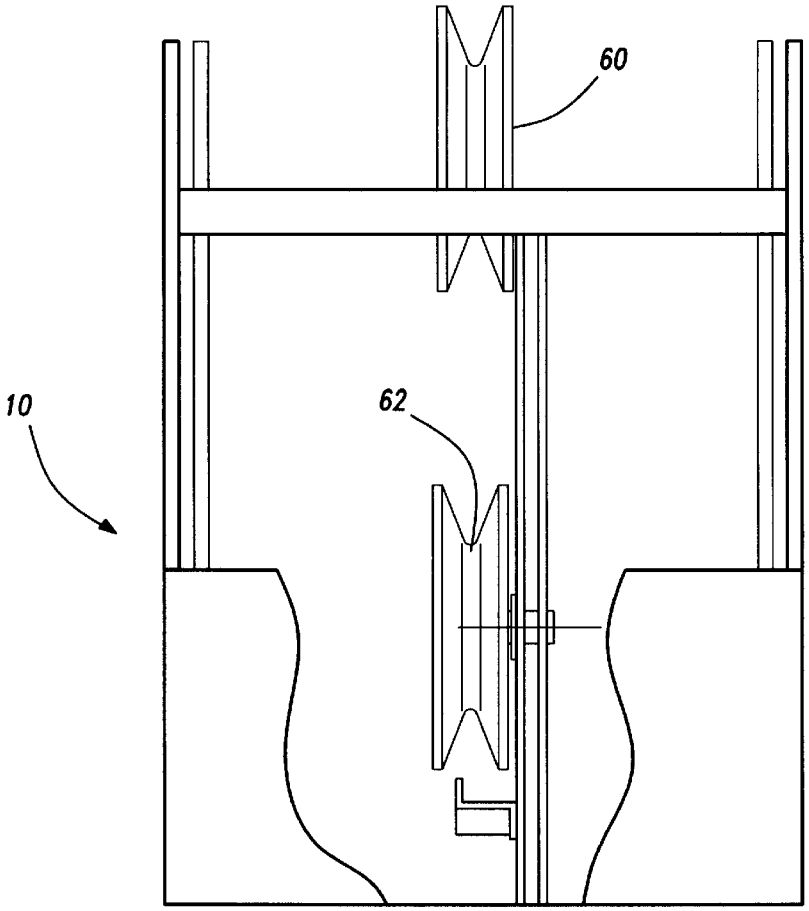
FIG. 4 is an end view diagrammatically illustrating the preferred embodiment of the present invention and with parts removed for clarity.

With reference now to FIGS. 2 and 3, the bearing assembly 44 for securing the bucket halves 12 and 14 together is there shown in greater detail. Furthermore, only one bearing assembly 44 along one side of the top of the bucket halves 12 and 14 will be described in detail, it being understood that a like description shall also apply to the bearing assembly 44 at the opposite side of the power bucket 10.

With reference then to FIGS. 2 and 3, an opening 40 having a preselected diameter is formed in each side 16 of the first bucket half 12 adjacent its top 20 so that the openings 40 register with each other. Similarly, an opening 42 is formed in each side 22 of the second bucket half 14 adjacent its top 26 so that the openings 42 register with each other as well as the openings 40 in the first bucket half 12. Furthermore, as best shown in FIG. 3, the opening 42 in the second bucket half 14 is substantially greater in diameter than the opening 40 in the first bucket half 12.

An annular bearing ring 45 having a circular opening 47 is secured to the bucket half 14 within the bucket opening 42. The ring 45 is constructed of a high strength and high wear material and is secured against rotation to the bucket half 14 by a key 49 (FIG. 2) and slot 51 arrangement.

The bearing assembly 44 includes an enlarged diameter cylindrical body 46 as well as a cylindrical pin 48 extending coaxially outwardly from one side of the body 46. The pin 48 has a diameter substantially the same as the opening 40 in the first bucket half 12 while, similarly, the cylindrical body 46 has a diameter substantially the same as the opening 47 of the bearing ring 45 secured to the second bucket half 14.

With the openings 40 and 42 in registration with each other, the bearing assembly 44 is positioned through the openings 40 and 47 so that the pin 48 is positioned within the opening 40 and, simultaneously, the cylindrical body 46 is positioned within the bearing ring opening 47. A circular cover 55 is positioned over the outer end of the body 46 such that the cover 55 overlaps the bearing ring 45. The bearing assembly 44 is then removably secured to the first bucket half 12 by bolts 50 extending through axial bores in the cover 55, the cylindrical body 46 and the first bucket half 12. Nuts 54 secure the bolts 50 in place and, in doing so, the bearing assembly 44 is firmly, but removably, secured to the first bucket half 12.

With the bearing assembly 44 secured to the first bucket half 12, the second bucket half 14 can pivot relative to the first bucket half such that the outer surface of the cylindrical body 46 and the opening 47 of the bearing ring form wear surfaces for the pivotal connection of the bucket halves 12 and 14. After excessive wear of the bearing assembly 44, typically through wear of the outer surface of the cylindrical body 46, the bearing assembly 44 can be replaced by removing the bolts 50 and reconnecting a new bearing assembly to the first bucket half 12. Furthermore, such replacement of the bearing assembly 44 can be relatively rapidly and inexpensively achieved.

With reference now particularly to FIG. 2, if desired, the bearing assembly 44 optionally includes a key 56 secured to the outer periphery of the pin 48. This key 56 is received within a notch 58 formed in the opening 40. The coaction between the key 56 and notch 58 protects the bolts 50 against torsional forces caused during the opening and closing of the bucket halves 12 and 14.

With reference to FIG. 3, an annular brace 71 is secured by welds to the first bucket half 12 such that the brace 71 overlaps the cylindrical body 46. The brace 71 strengthens the connection between the body 46 and the bucket half 12.

With reference again to FIG. 1, in order to move the bucket halves 12 and 14 between their opened and closed positions, three pulleys 60, 62 and 64 are rotatably mounted to the power bucket. The first pulley 60 is rotatably mounted to one of the bucket halves adjacent the top 20 or 26. The second pulley 62 is rotatably mounted within the interior of the second bucket half 14 adjacent the bottom 24 of the second bucket half. Similarly, the third pulley 64 is mounted within the interior of the first bucket half 12 adjacent its bottom 18. All three pulleys 60, 62 and 64, however, are aligned with each other as well as the center line of the power bucket 10.

A closure line 66 is sequentially disposed around the pulleys 60, 62 and 64 and ultimately has an end 68 fixedly secured to the first bucket half 14 adjacent the pulley 62. Consequently, extension or retraction of the closure line 66 moves the bucket halves 12 and 14 between their open position 30 (FIG. 5) and closed position 32 (FIG. 5) in the well known fashion.

Figure 6:
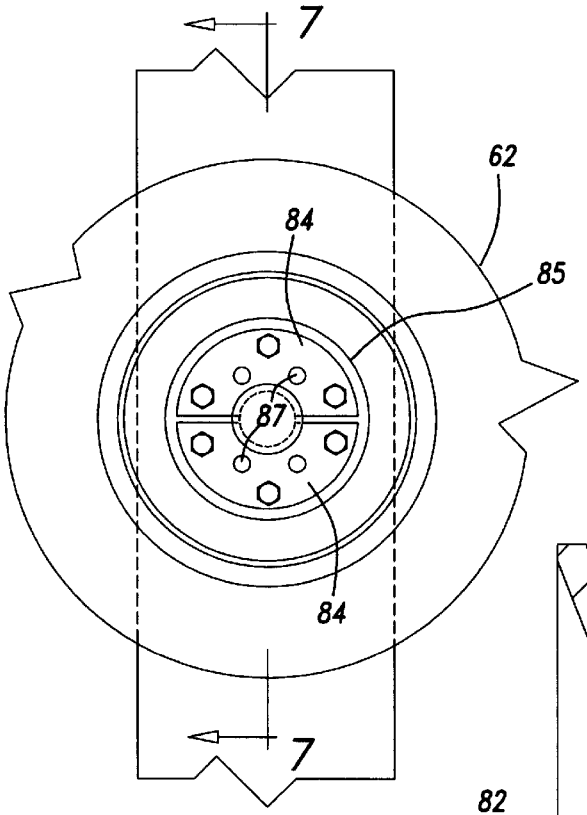
FIG. 6 is an enlarged view illustrating one closure pulley of the preferred embodiment of the present invention.
Figure 7:
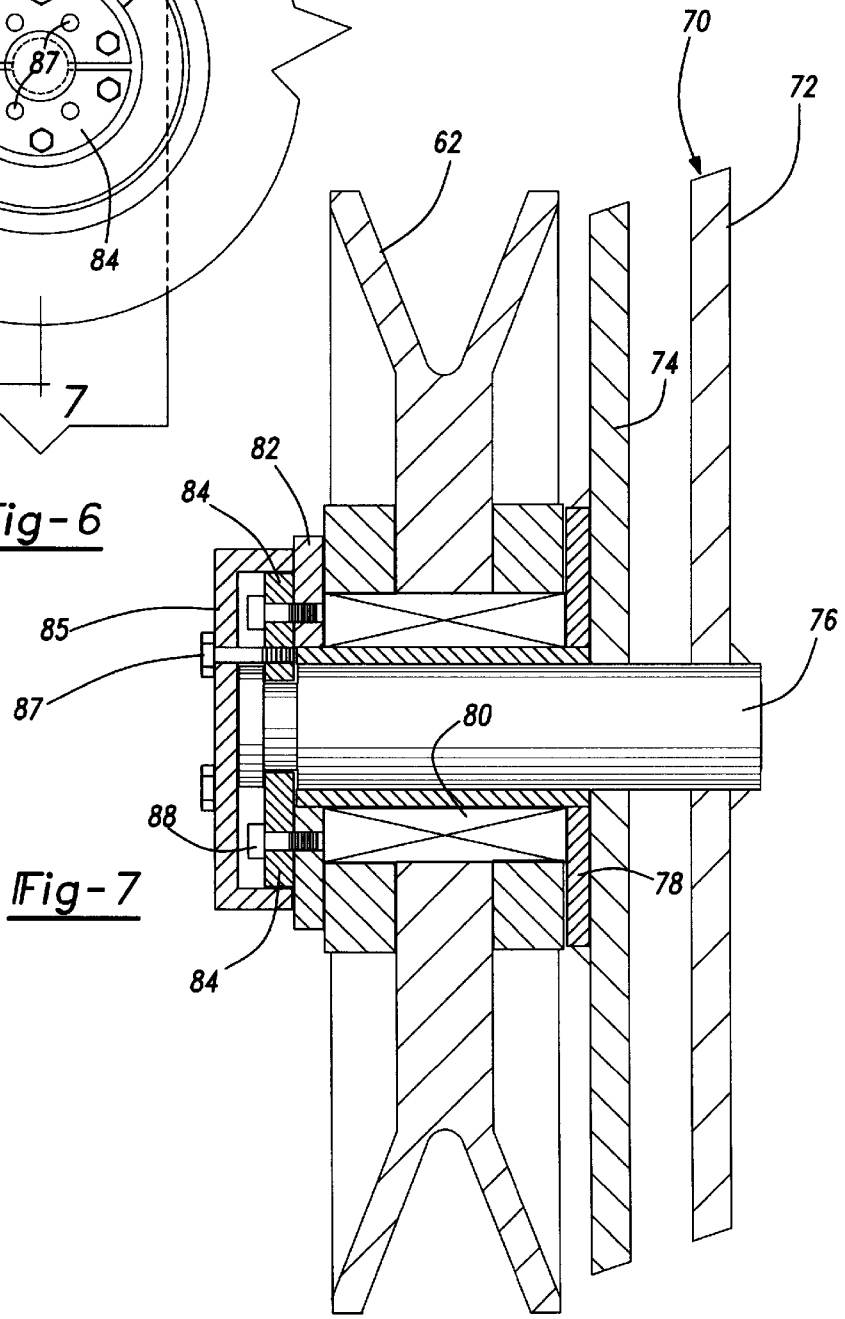
FIG. 7 is a sectional view taken substantially along line 7—7 in FIG. 6 and enlarged for clarity.

With reference now to FIGS. 6 and 7, the rotational mounting of the pulley 62 is there shown in greater detail. Furthermore, the mounting of the pulley 62 will be described in detail, it being understood that a like description shall also apply to the mounting of the pulley 64.

With reference then to FIGS. 6 and 7, the second bucket half 14 includes a center wall assembly 70 which is substantially parallel to the sides 22 and 24 (FIG. 1) of the bucket half 14. As best shown in FIG. 7, the center wall assembly includes a pair of wall sections 72 and 74 that are spaced apart from and parallel to each other.

A stub axle 76 is then fixedly secured to the wall sections 72 and 74 by welding so that the stub axle 76 protrudes outwardly from one side of the wall section 70. An annular wear plate 78 is then positioned over the stub axle 76 and against one wall section 74. The plate 78 is preferably tack welded to the center wall assembly 70.

The pulley 62, including its contained bearing system 80, is then axially slid over the stub axle 76 so that one end abuts against the wear plate 78. A second wear plate 82 is then slid over the stub axle 76 so that it abuts against the side of the pulley 62 opposite from the wear plate 78. A pair of semicircular retaining plates 84 fit within a notch 86 at the free end of the stub axle 76 and are removably secured to the bearing ring 82 by bolts 88. A circular cover 85 is preferably positioned over the plates 84 and against the bearing ring 82 to protect the bearing system 80 from debris. The cover 85 is secured to the plates 84 by bolts 87. Consequently, whenever repair or replacement of the pulley assembly 62, bearing system 80 and/or the wear plates 78 and 82 are required, the bolts 87 and 88 are simply removed and the appropriate parts repaired or replaced.

The construction and mounting of the pulley 62 thus provides several advantages. One advantage is that, since the stub axle 76 merely protrudes from the center wall 72, cleaning of the interior of the bucket halves can still be easily achieved. Furthermore, the double wall construction of the center wall prevents bending or deflection of the stub axle 76 despite high lateral forces imposed upon the stub axle 76 by the closure line 66.

With reference now to FIG. 5, a still further improvement of the present invention is there shown in which an elongated chain 90 extends between and is secured to the bucket halves 12 and 14 at its opposite ends. The elongated chain 90, which alternatively can comprise a cord, thus limits the maximum opening of the bucket halves 12 and 14.

In order to protect the chain 90 from damage upon closure of the bucket halves 12 and 14, a pair of elongated tubes 92 and 94 are secured to the chain 90 at opposite ends of the chain 90 so that only a central portion 96 of the chain 90 is uncovered by the tubes 92 and 94. The central section 96 is, in turn, secured to the top of the power bucket 10 by a chain 98.

In practice, the tubes 92 and 94 prevent the chain 90 from being caught between the bucket halves as the bucket halves 12 and 14 are moved to their closed position. As such, the tubes 92 and 94 protect the chain 90 from damage during closure of the bucket halves 12 and 14.

From the foregoing, it can be seen that the power bucket of the present invention provides a power bucket with many improvements and advantages over the previously known power buckets. Having described my invention, however, many modifications thereto will become apparent to those skilled in the art to which it pertains without deviation from the spirit of the invention as defined by the scope of the appended claims.

I claim:

1. A power bucket comprising:

a first bucket half forming a first scoop, said first bucket half having a top, a bottom and two spaced sides, said first bucket half having a pair of first registering openings formed in said sides adjacent said top, a second bucket half forming a second scoop, said second bucket half having a top, a bottom and two spaced sides, said second bucket half having a pair of second registering openings formed in said sides adjacent said top, said second openings being greater in diameter than said first openings and in registration with said first openings, means for pivotally securing said bucket halves together along said top so that said bucket halves are movable between an open position and a closed position, said pivotal securing means comprising a pair of bearing assemblies, each bearing assembly comprising a cylindrical body pivotally positioned in said second opening and a cylindrical pin extending coaxially outwardly from one side of said body, said pin having a diameter substantially the same as said first opening, means for removably securing said bearing assemblies to opposite sides of said first bucket half so that said pins we respectively positioned in said first openings and said bodies are respectively positioned in said second openings wherein said removable securing means comprises a plurality of fastners extending through said body and securing said body against movement to said first bucket half.

2. The power bucket as defined in claim 1 and comprising an annular bearing ring positioned between said cylindrical body and said opening in said second bucket half.

3. The power bucket as defined in claim 1 and comprising an annular brace fixedly secured to said first bucket half such that said brace overlaps a portion of said body.

4. The power bucket as defined in claim 1 wherein said removable securing, means comprises a plurality of bolts extending through said body and threadably engaging threaded bores in said first bucket half.

5. The power bucket as defined in claim 1 wherein said first bucket half comprises a notch extending outwardly from each of said first openings and wherein each said bearing assembly comprises a key extending outwardly from each of said pins, each of said keys being positioned within one of said notches.

6. A power bucket comprising:

a first bucket half forming a first scoop, said first bucket half having a top, a bottom and two spaced sides, said first bucket half having a pair of first registering openings formed in said sides adjacent said top, a second bucket half forming a second scoop, said second bucket half having a top, a bottom and two spaced sides, said second bucket half having a pair of second registering openings formed in said sides adjacent said top, said second openings being greater in diameter than said first openings and in registration with said first openings, means for pivotally securing said bucket halves together along said top so that said bucket halves are movable between an open position and a closed position, each bucket half having a center wall section positioned substantially midway between and substantially parallel to said sides, means for selectively moving said bucket halves between said open and said closed position comprising a stub axle having one end secured to each said center wall, a pair of pulleys, one pulley being rotatably mounted to each stub axle, and a closure line disposed around said pulleys.

7. The power bucket as defined in claim 6 wherein each stub axle includes an annular groove adjacent a free end and means for detachably securing said pulleys to their respective stub axles comprising a bearing ring having a central opening substantially the same as said stub axle so that with said bearing ring positioned on its respective stub axle, said pulley is entrapped between said center wall and said ring, and a split retaining ring having an opening substantially the same diameter as said stub axle groove, and means for detachably securing said split ring to said stub axle.

8. The power bucket as defined in claim 7 and comprising a pair of second bearing rings, one of said second bearing rings being positioned between each of said pulleys and its respective center wall section.

9. The power bucket as defined in claim 6 wherein said center wall section comprises a pair of spaced apart plates.

10. A power bucket comprising:

a first bucket half forming a first scoop, said first bucket half having a top, a bottom and two spaced sides, said first bucket half having a pair of first registering openings formed in said sides adjacent said top, a second bucket half forming a second scoop, said second bucket half having a top, a bottom and two spaced sides, said second bucket half having a pair of second registering openings formed in said sides adjacent said top, said second openings being greater in diameter than said first openings and in registration with said first openings, means for pivotally securing said bucket halves together along said top so that said bucket halves are movable between an open position and a closed position, said pivotal securing means comprising a pair of bearing assemblies, each bearing assembly comprising a cylindrical body pivotally positioned in said second opening and a cylindrical pin extending coaxially outwardly from one side of said body, said pin having a diameter substantially the same as said first opening, means for removably securing said bearing assemblies to opposite sides of said first bucket half so that said pins are respectively positioned in said first openings and said bodies are respectively positioned in said second openings, an annular brace fixedly secured to said first bucket half such that said brace overlaps a portion of said body.

11. A power bucket comprising:

a first bucket half forming a first scoop, said first bucket half having a top, a bottom and two spaced sides, said first bucket half having a pair of first registering openings formed in said sides adjacent said top, a second bucket half forming a second scoop, said second bucket half having a top, a bottom and two spaced sides, said second bucket half having a pair of second registering openings formed in said sides adjacent said top, said second openings being greater in diameter than said first openings and in registration with said first openings, means for pivotally securing said bucket halves together along said top so that said bucket halves are movable between an open position and a closed position, said pivotal securing means comprising a pair of bearing assemblies, each bearing assembly comprising a cylindrical body pivotally positioned in said second opening and a cylindrical pin extending coaxially outwardly from one side of said body, said pin having a diameter substantially the same as said first opening, means for removably securing said bearing assemblies to opposite sides of said first bucket half so that said pins are respectively positioned in said first openings and said bodies are respectively positioned in said second openings, wherein said removable securing means comprises a plurality of bolts extending through said body and threadably engaging threaded bores in said first bucket half.

12. A power bucket comprising:

a first bucket half forming a first scoop, said first bucket half having a top, a bottom and two spaced sides, said first bucket half having a pair of first registering openings formed in said sides adjacent said top, a second bucket half forming a second scoop, said second bucket half having a top, a bottom and two spaced sides, said second bucket half having a pair of second registering openings formed in said sides adjacent said top, said second openings being greater in diameter to said first openings and in registration with said first openings, means for pivotally securing said bucket halves together along said top so that said bucket halves are movable between an open position and a closed position, said pivotal securing means comprising a pair of bearing assemblies, each bearing assembly comprising a cylindrical body pivotally positioned in said second opening and a cylindrical pin extending coaxially outwardly from one side of said body, said pin having a diameter substantially the same as said first opening, means for removably securing said bearing assemblies to opposite sides of said fist bucket half so that said pins are respectively positioned in said first openings and said bodies are respectively positioned in said second openings, wherein said first bucket half comprises a notch extending outwardly from each of said first openings and wherein each said bearing assembly comprises a key extending outwardly from each of said pins, each of said keys being positioned within one of said notches.

* * * * *